US005132595A

United States Patent [19]

Kulka et al.

[11] Patent Number: 5,132,595

[45] Date of Patent: Jul. 21, 1992

[54] FILMENT SWITCH FOR A LAMP BALLAST

[75] Inventors: Robert A. Kulka, Livingston, N.J.; Frederick P. Bauer, Mendenhall, Miss.

[73] Assignee: Magnetek Universal Mfg. Co., Paterson, N.J.

[21] Appl. No.: 541,609

[22] Filed: Jun. 21, 1990

[51] Int. Cl.[5] ..... H05B 39/00

[52] U.S. Cl. ..... 315/106; 315/101; 315/107

[58] Field of Search ..... 315/106, 107, 101

[56] References Cited

U.S. PATENT DOCUMENTS 4,010,399 3/1977 Bessone ..... 315/106

FOREIGN PATENT DOCUMENTS 52-4672 1/1977 Japan ..... 315/106

*Primary Examiner*—Eugene R. LaRoche
*Assistant Examiner*—R. A. Ratliff
*Attorney, Agent, or Firm*—Darby & Darby

[57] ABSTRACT

A filament switch for a rapid start fluorescent lamp disconnects or reduces through phase modulation the heating current to a plurality of lamp filaments to save power. The switch uses a trigger in series with a voltage sensitive element and an impedance element, the switch being responsive to the difference between a lamp starting voltage and a lamp sustaining voltage for determining when and for how long the filaments are heated.

18 Claims, 5 Drawing Sheets

OSCILLISCOPE TRACING FOR SWITCH OPERATING IN PARTIAL HEATING MODE

FILMENT SWITCH FOR A LAMP BALLAST

TECHNICAL FIELD

This invention relates to fluorescent lamp ballasts and more particularly, to a filament switch for reducing energy consumption in a lamp ballast.

BACKGROUND OF THE INVENTION

An electromagnetic rapid start fluorescent lamp typically utilizes continuously excited filaments to provide a thermionic emission of electrons that aid in lamp starting, the excitation heating the filaments. Such a lamp uses a ballast which applies an output voltage across the lamp which will "strike" (i.e., initiate light emission from) the lamp when the filaments are heated, but which will not strike the lamp when the filaments are not heated. If a higher voltage ballast is used, the lamp can instant strike without heating the filaments. However, using high voltage to instant strike a lamp will eventually damage an emissive coating usually applied to the filaments and thus shorten lamp life. Additionally, due to the higher voltage, the instant strike lamps are more costly and less efficient than heated filament lamps.

One of the most common ballasts used in rapid start fluorescent lamps is a two lamp F40T12 rapid start ballast made by MagneTek Universal Mfg., which typically uses about 87 watts of power. In a fixture using such a ballast, the two lamps have a total of four filaments, each of which require about one watt of heating power. In addition, another watt is lost in the ballast filament transformer windings, with filament heating consuming about 6% of the total power consumed by the lamps and ballast. Turning off the power for filament heating after a lamp has struck does not have a noticeable effect on lamp light output, the only adverse effect being a slight reduction in lamp life. However, the cost of energy saved by removing filament heating after striking exceeds the cost incurred due to slightly shortened lamp life.

Many schemes have been proposed over the years for reducing filament heating requirements. For example, U.S. Pat. No. 2,330,312 to Raney shows a relay in series with a lamp which electrically isolates a filament after the lamp strikes. Such series devices have problems in maintaining long term contact reliability, and still consume some power after the lamps are struck. U.S. Pat. No. 4,010,399 to Latassa shows a triac in series with each lamp filament, the triacs being responsive to the difference in filament current before and after the lamp is struck, to reduce power consumption. This circuit is, however, sensitive to changes, with temperature and time, in triac trigger current and lamp filament voltage. Also, these circuits typically experience unit to unit differences. U.S. Pat. No. 4,399,391 to Hammer teaches a separate filament transformer in series with a capacitor and a bilateral voltage sensitive switch such as a sidac. Such a combination of components requires additional housing space and still consumes some power.

SUMMARY OF THE INVENTION

It is an object of the present invention to save electrical energy in a fluorescent lamp assembly by terminating or reducing the filament heating power after the lamp has been struck, and to do so with a minimum of components.

According to the present invention, a filament circuit is disclosed comprising a triggered switch disposed in series with an output lead of each ballast filament. The triggered switch is placed in series with voltage sensitive means and current limiting impedance means. Circuit operation is dependent on the voltage used to start the lamp being higher than the voltage used to operate the lamp. Circuit values are chosen such that the voltage sensitive means triggers (closes) the 15 triggered switches when the higher starting voltage is applied and the switches are inactivated (opened) when the voltage across the lamp drops to the operating level after the lamp is struck. Alternately, the triggered switch can be phase displaced to reduce, rather than eliminate the operating filament voltage.

Preferably, the triggered switch is a sensitive gate triac. The voltage sensitive means may be a combination of zener diodes and a bilateral switch such as a sidac. The current limiting impedance means may be capacitors and/or resistors.

Preferably, the ballast usable with this invention is modified to have a higher filament output voltage to compensate for the presence of the switch in the circuit. However, even with this change, power requirements, overall, are reduced as compared to the prior art.

DETAILED DESCRIPTION OF THE INVENTION

Figure 1:
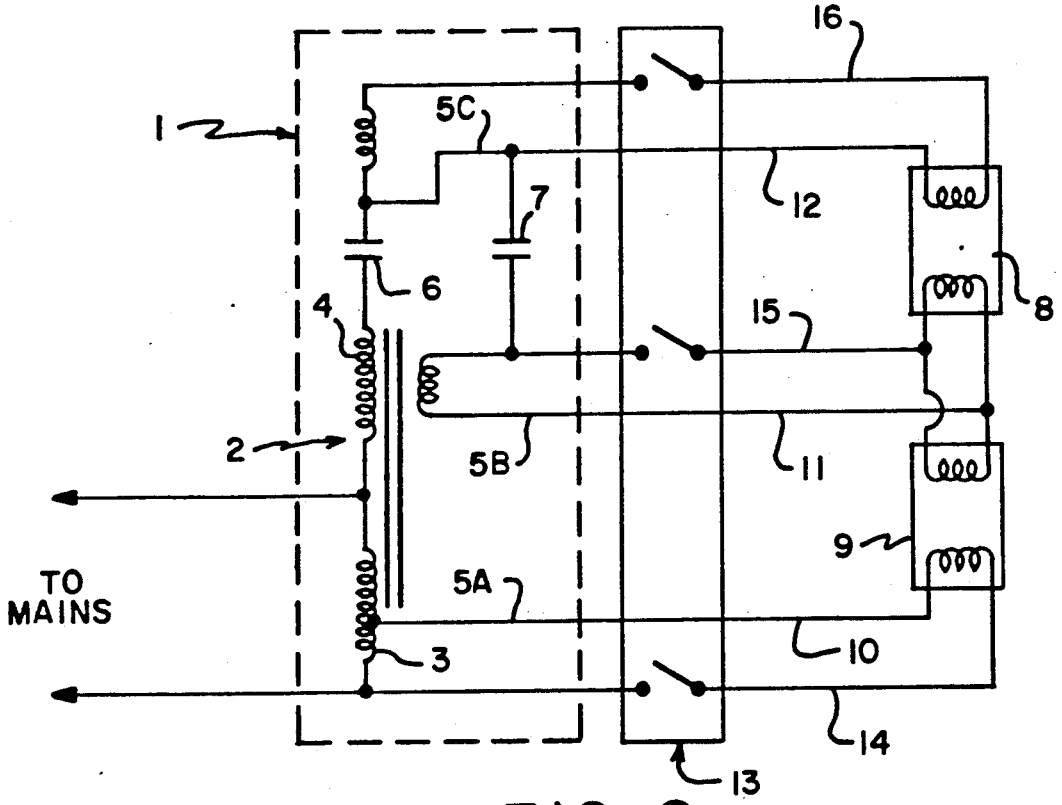
FIG. 1 is a system schematic of the present invention using a two lamp electromagnetic ballast with a three pole filament switch.

Referring to FIG. 1, an electromagnetic ballast 1 is shown having an autotransformer 2 with a primary winding 3, a secondary winding 4 loosely coupled to the primary, and three filament windings, 5A, 5B and 5C, respectively, preferably tightly coupled to the primary. "Tightly coupled" means nearly all the flux of the primary coil is also underneath the secondary coil. "Loosely coupled" means that only a portion of the flux of the primary coil is under the secondary. Either type ballast could be used with this invention.

A capacitor 6 is connected in series with the autotransformer to limit the output current and to correct the power factor. This capacitor preferably has a value of four microfarads when used with two lamps. A small auxillary capacitor 7, having a rating of about 0.01 to 0.1 microfarads, bypasses a lamp 8 at the moment of starting, putting the full ballast voltage across a lamp 9, thereby reducing the total voltage needed to start the two lamps. Leads 10, 11 and 12 are filament leads which are directly connected from one side of each of the filament windings 5A, 5B, 5C to the filaments fluorescent lamps. The other filament leads are connected to a three pole switch 13 by leads 14, 15 and 16. When the switch 13 is closed, the filaments are heated and the lamps start in the normal rapid start mode. Once the lamps have started the switch 13 is to be opened, and the already struck lamp arc will be sustained.

Figure 2:
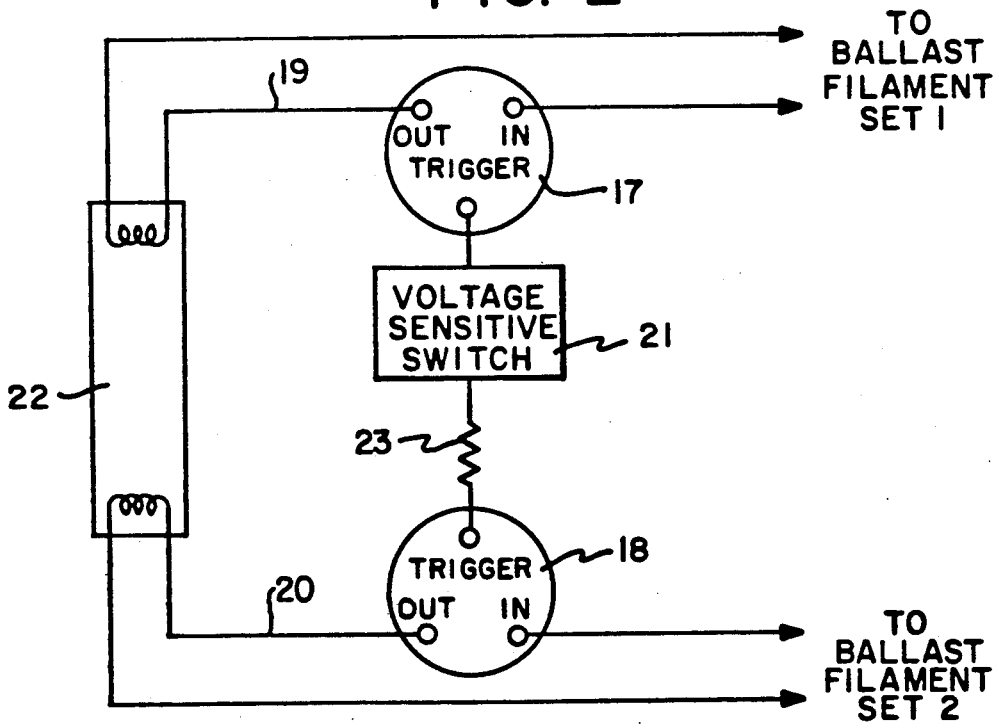
FIG. 2 is a system schematic of a two pole switch for use with a one lamp ballast according to the present invention.

Referring to FIG. 2, the invention is shown in block diagram form for a single lamp ballast. Two triggered switches 17 and 18 are separately connected in series with the lamp filaments 19 and 20 of a lamp 22 and the transformer filament secondary winding (not shown). A voltage sensitive switch 21 is connected so that it both senses the voltage across lamp 22 and controls the triggered switches 17 and 18. When the threshold value of the voltage sensitive switch 21 is exceeded, a current flows into the trigger activating those switches 17, 18. An impedance 23 limits the value of the trigger port current. Typically, the output voltage from a one lamp starting ballast will be 230 volts rms with a peak of 310 volts. When the lamp arc is struck the voltage drops to about 110 volts rms and 140 volts peak. Therefore, if the voltage sensitive switch is chosen to turn on at 175 volts, the triggered switches will be activated when the lamp arc has not been established, and the switches will be off after the lamp is struck and the lamp voltage drops below 175 volts.

Figure 3:
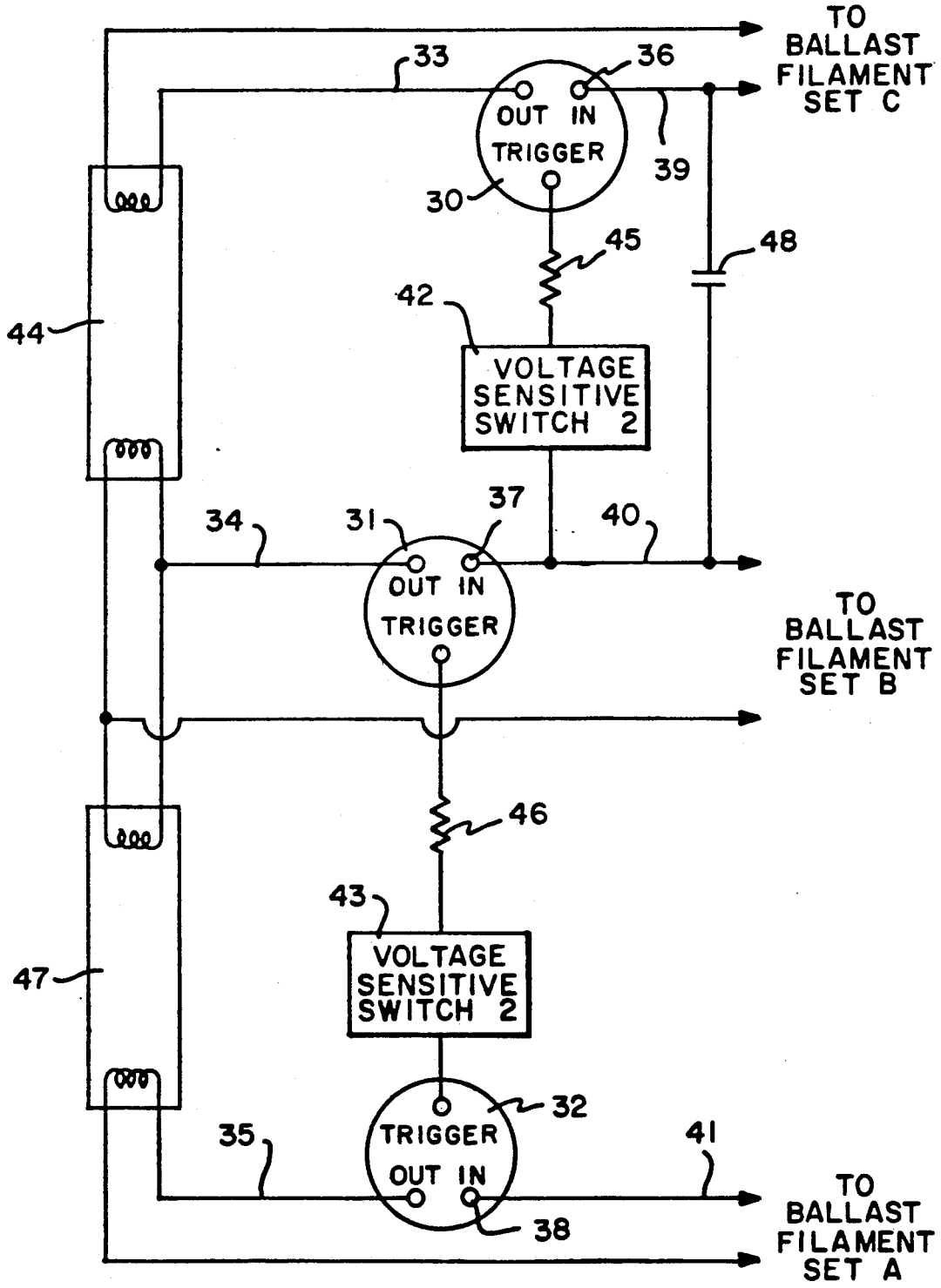
FIG. 3 is a system schematic of a three pole switch for use with a two lamp rapid start ballast according to the present invention.

FIG. 3 shows a block diagram of the invention for use in a two lamp ballast. There are 3 triggered switch elements 30, 31 and 32, the output of the switches being connected via leads 33, 34 and 35 to the ends of the lamp filaments. The switch input terminals 36, 37 and 38, are connected to the ballast filament secondary windings (not shown) via leads 39, 40 and 41. Two voltage sensitive switches 42 and 43 are connected as follows. Voltage switch 42 is connected so as to sense the voltage across a lamp 44 and is serially connected between the trigger ports of switches 30 and 31. An impedance 45 is also placed in series with the trigger ports to limit the current. Switch 31 is connected serially to an impedance 46 and to voltage switch 43 so that voltage switch 43 senses the voltage across lamp 47.

The no load output voltage of a ballast for use with two lamps will be about 285 volts rms and about 445 volts peak. Once the lamp is struck, the voltage across each lamp drops to about 110 volts rms and about 140 volts peak. The total voltage across the two lamps is the sum of those voltages or 220 volts rms and 280 volts peak. It should also be noted that lamp 44 is bypassed by an auxillary starting capacitor 48.

The switches can now be set to operate in two different sequences. In one sequence a larger value auxillary capacitor is used. At start up, the output voltage sensitive sensed by voltage switch 43 is nearly the ballast output voltage. The voltage across lamp 44 at this time is determined by the auxillary capacitor impedance and the current flowing through that capacitor into lamp 47 and the switch circuit impedance around lamp 47. Component values can be chosen such that when voltage sensitive switch 43 is turned on it in turn turns on switches 31 and 32 but triggered voltage switch 30 is off. Assuming this to be the case, then voltage sensitive switch 43 is on and in turn triggered switches 31 and 32 are on. The filaments in lamp 47 are heated by the filament secondary windings of the ballast. A glow is now established in lamp 47. The glow current is a function of the series impedance of the auxillary capacitor, since the current through the auxillary capacitor increases the voltage across that capacitor and across the voltage sensitive switch 42. If the value of voltage switch 42 is chosen properly it will turn on, and in turn, filament trigger switch 30 is also turned on. The glow voltage across lamp 47 is still high enough to keep voltage sensitive switch 43 on. All filaments are on at this time. Now an arc can be struck in lamps 44 and 47 in the same fashion as would happen in a standard rapid start ballast. Once the lamp arc has struck, the voltage drops and the voltage sensitive switches 42, 43 turn off and turn off the triggered switches 30, 31, 32. The filaments are thus disconnected from one side of the filament windings.

Another starting sequence can be obtained by using a lower value auxillary capacitor 48 and choosing circuit values such that the initial voltage across the auxillary capacitor 48 will turn on voltage sensitive switch 42 concurrently with switch 43. This sequence has the disadvantage of reducing the voltage seen by lamp 44 at start up.

Figure 4:
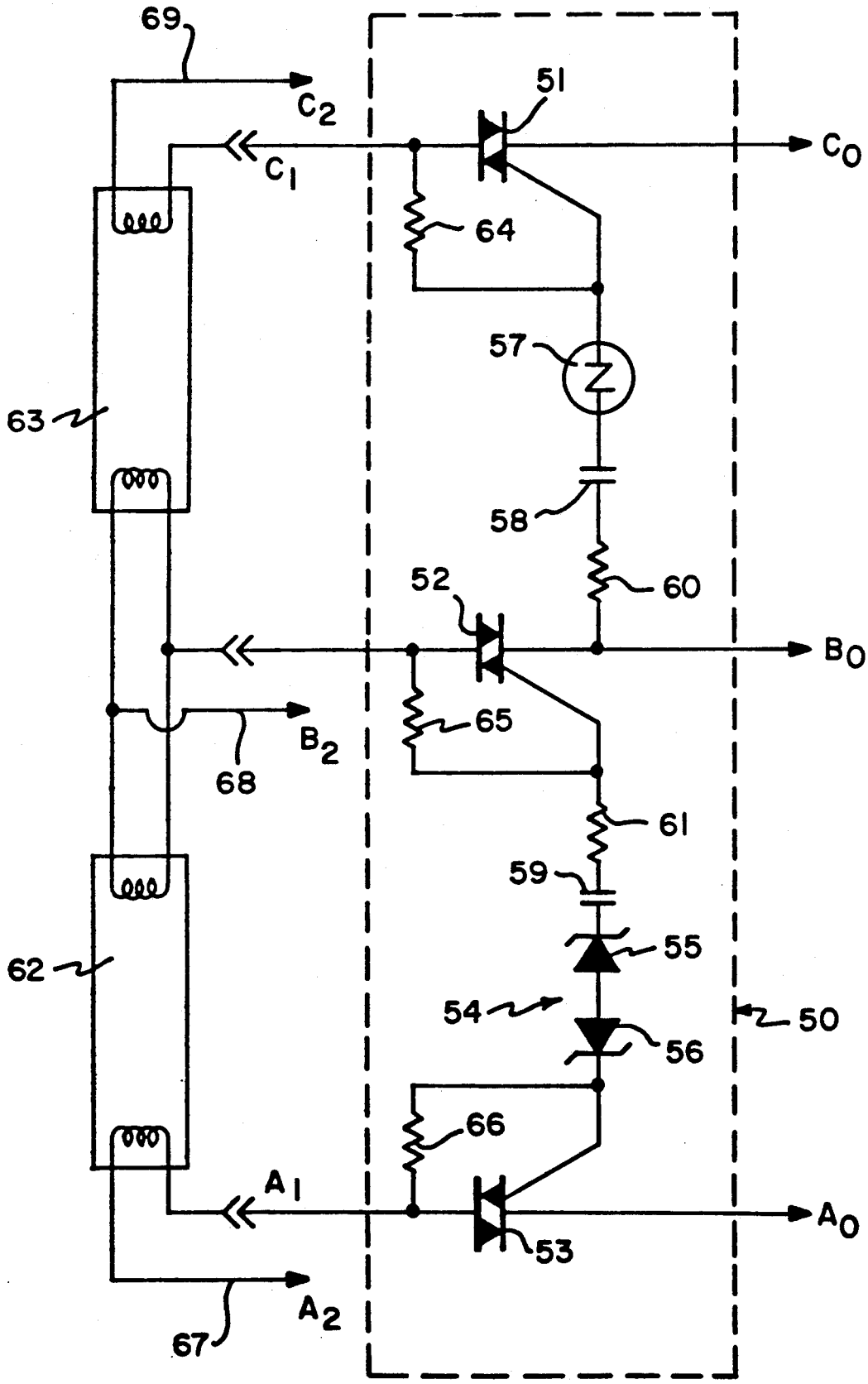
FIG. 4 is a system schematic of a preferred embodiment of the present invention.

FIG. 4 shows a preferred embodiment of the present invention, using a filament switch assembly 50 in conjunction with a two lamp electromagnetic ballast.

The triggered switch elements are 51, 52 and 53 which are sensitive gate triacs such as Teccor L401E3, made by Teccor Corp., Irving, Tex., with gate current for turn on of 2 milliamperes or less. A voltage sensitive switch 54 is formed of two back to back 175 volt zener diodes 55 and 56. Voltage sensitive switch 57 is a nominal 200 volt sidac. The trigger current is limited by 0.05 microfarad capacitors 58 and 59 and resistors 60 and 61 which limit the inrush currents to capacitors 58 and 59.

At turn on, current flows through the auxillary capacitor (not shown) zener diodes, 55, 56, capacitor 59, and the gate and main terminals the triggered switches of 52 and 53 whenever the instantaneous voltage exceeds 175 volts. The peak applied voltage is about 400 volts and the peak gate current is about 4 milliamperes. The voltage drop across the auxiliary capacitor caused by the gate current will not be high enough to trigger sidac 57. Triacs 52 and 53 will be turned on and the filaments of a lamp 62 will now be heated. A glow discharge current of about 10 milliamps will occur in lamp 62. This current will also flow through the auxillary capacitor (not shown) and raise the voltage across sidac 57. Sidac 57 now turns on and in turn triggers triac 51. All the filaments are now on and both lamps 62 and 63 are struck. Once the lamp arcs are struck, the voltage across both the sidac 57 and zener diodes 55 and 56 drop below the threshold levels and triacs 51, 52 and 53 are turned off. The filament heating coils are now 15 disconnected from the circuit.

Resistors 64, 65, and 66 are placed in the circuit from the gate to the lamp as a precaution if lines 65, 68 or 69 are opened during lamp operation. If line 62, 68 or 69 is opened when the lamps are on, and triacs 51, 52 and 53 are off, there could be a damaging voltage transient. The main terminal to gate resistor limits the value of that transient seen by the triac.

The filament switch can be used either internal to the ballast or as an external ballast peripheral. Preferably, the first starting sequence is such that the lamp 62 filaments are turned on before lamp 63 filaments, and the auxillary starting capacitor is chosen to be on the high side of the normal range (about 0.1 microfarads).

The presence of the filament switch lowers the filament voltage due to 1) the insertion loss of the triacs (about ¾ volt; and 2) the delayed turn of the triacs (i.e., the filament voltage is not on for 360 electrical degrees). To compensate for this voltage loss, the filament winding output voltage of the ballast should be raised. For example, the nominal output voltage of 4 volts rms could be increased to slightly less than 6 volts rms. This ensures that the actual voltage at the filaments are restored to the nominal 4 volts.

Although little can be done to reduce the insertion loss due to the on state voltage insertion losses of the triac, improvements can be made to restore the filament on-time.

Figure 5:
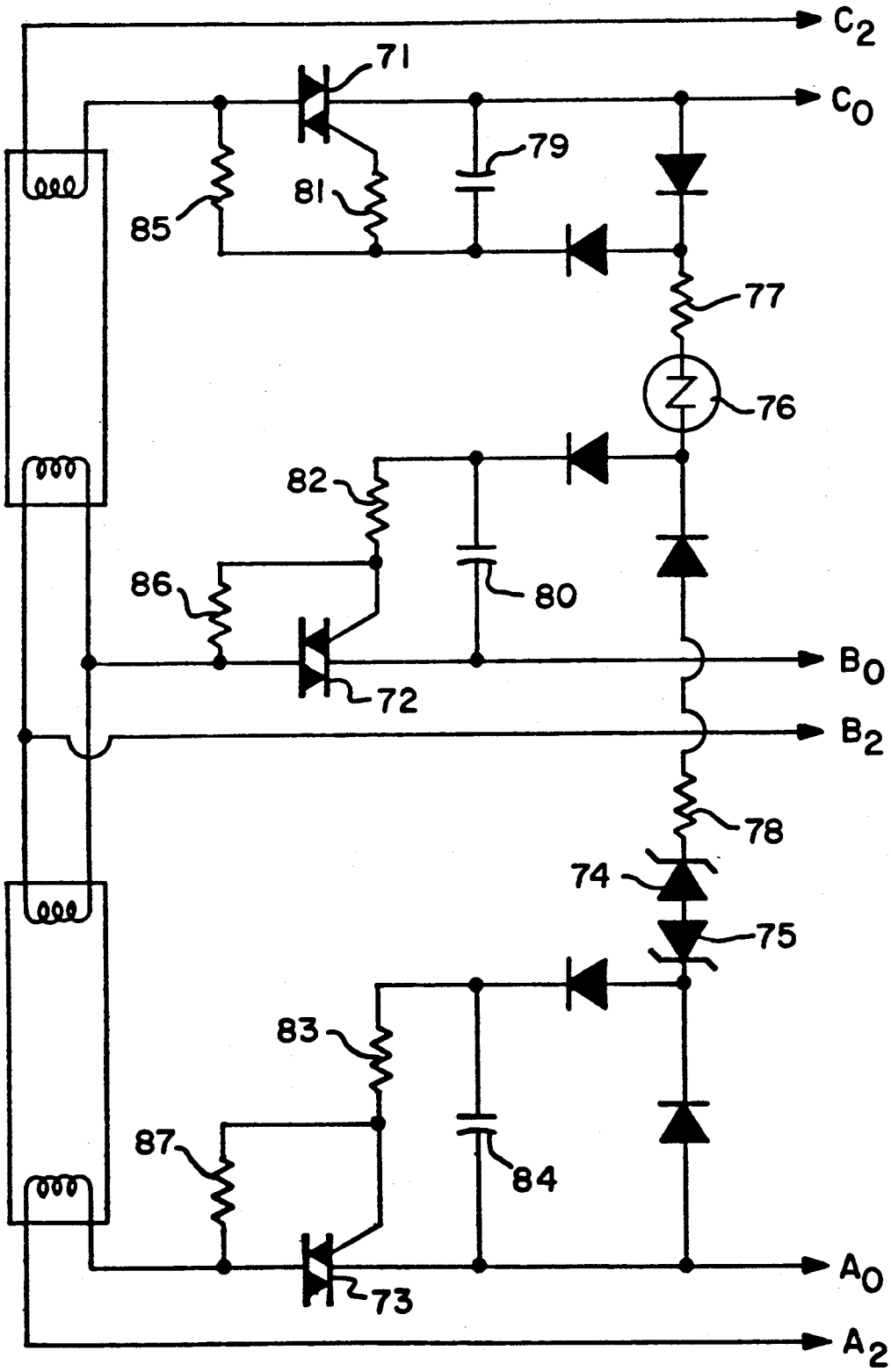
FIG. 5 is a system schematic of another embodiment of the present invention.

Referring to FIG. 5, an alternate embodiment of the invention is shown. Similar to the last example, 71, 72 and 73 are the triggered gate triacs and zener diodes 74 and 75 and sidac 76 are the voltage sensitive switch elements. Resistors 77 and 78 are the gate current limiting resistors (5,100 ohms each). Higher currents are required through the voltage sensitive switches than the previous example to ensure that capacitors 79 and 80 retain enough voltage to keep the triacs on throughout the electrical cycle while the voltage sensitive elements 74, 75 and 76 are on. Resistors 81, 82 and 83 control the discharge time of capacitors 79, 80 and 84 and limit the current to the triac gates. Resistors 85, 86 and 87 are used for voltage transient protection. Resistors 77 and 78 in this example must be able to dissipate more power during the lamp starting or dead lamp conditions.

Figure 6:
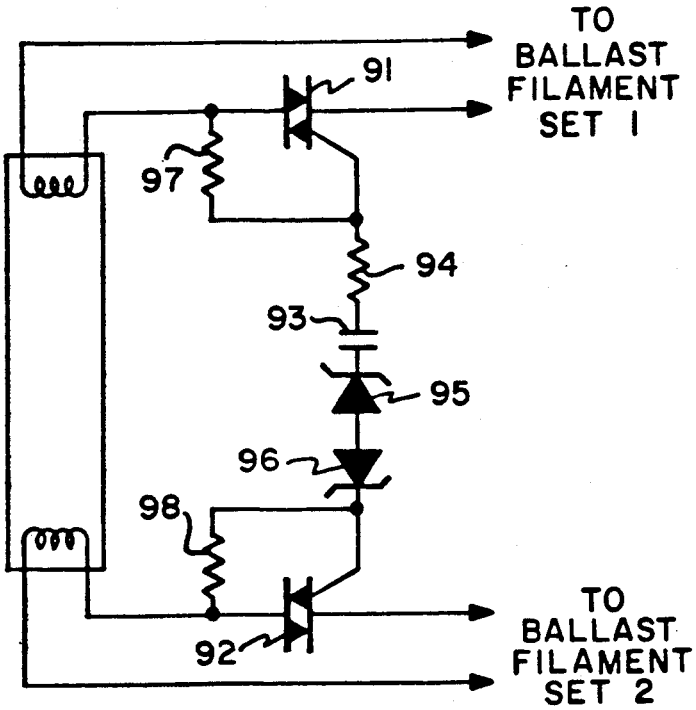
FIG. 6 is a system schematic of a two pole switch for use with a one lamp rapid start ballast according to the present invention.

FIG. 6 shows the schematic for this invention when the switch is used with a one lamp ballast. 91 and 92 are sensitive gate triacs. The gates of those triacs are serially connected through capacitor 93 (0.05 microfarads), resistor 94 (4,700 ohms) and back-to-back zener diodes 95 and 96 (175 volts nominal turn on). Capacitor 93 and resistor 94 limit the current in the triac gate when the zener diodes conduct. Resistors 97 and 98 are used for transient voltage protection of the triacs. The ballast open circuit peak voltage is about 300 volts. As soon as the voltage exceeds 175 volts the zener diodes start to conduct and shortly after that the gate to main terminal current in the triacs will be high enough to turn on triacs 91 and 92. When 91 and 92 are on, the filaments will heat up and the lamp can start in the normal rapid start mode. Once the lamps are struck the lamp voltage will drop to 140 volts peak. That voltage is not adequate to turn on the zener diodes in the gate circuit. The filament heating power is removed and the lamp arc is maintained.

The operating modes discussed so far have been based on completely turning off the triacs after the lamps are struck. This invention also contemplates an alternate mode in which a slight amount of continuous filament heating is provided. This mode is usable only when a lead ballast is used (i.e., the lamp current leads the line voltage). Since the two lamp ballast example used here has a capacitor in series with the lamp load, this mode applies to the electromagnetic ballast shown in FIG. 1.

Figure 7:
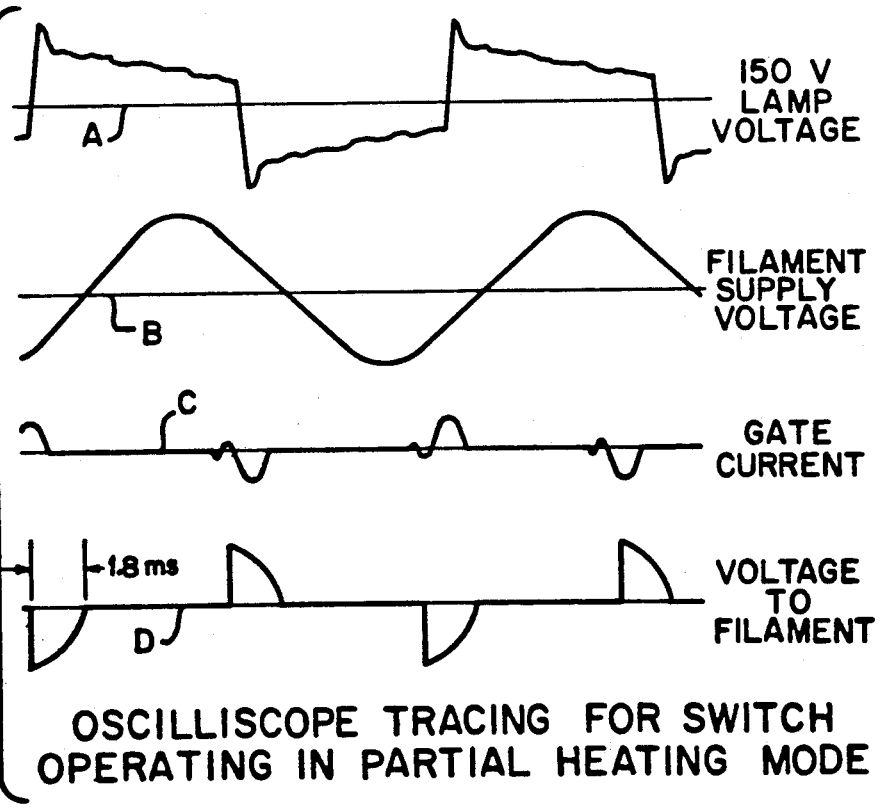
FIG. 7 is an oscilloscope trace of voltages and currents in a filament switch during an exemplary mode of operation.

To operate in this partial heating mode requires the proper choice of threshold voltage for the voltage sensitive switching elements (i.e., zener diodes 74 and 75 and sidac 76 of FIG. 5 and zener diodes 95, 96 and capacitor 93 of FIG. 6). This value should be slightly less than the peak instantaneous lamp voltage. Some caution should be used if the ballast is intended for use with more than one lamp type. It is common to use either standard lamps or energy saving lamps with the same ballast. In that case, the energy saving lamp will have a slightly higher peak voltage than the standard lamp The example shown in FIG. 7 is based on a two lamp rapid start ballast operating energy saving lamps. In this case, the voltage sensitive elements were chosen to have a nominal 130 volt threshold. As shown in FIGS. 7, lines A and B, the lamp voltage leads the filament voltage by about 2¼ milliseconds. It can also be seen that the lamp voltage has a relatively steep rise time. As a result, the peak of the lamp voltage leads the filament voltage by about 1.8 milliseconds (the equivalent of 39 electrical degrees). The triggered switch element then turns on slightly before that peak. As shown by line D, the filament voltage is on for the last 1.8 milliseconds of each half cycle when the lamps are on. The formula for determining the rms voltage delivered to a resistive load from a phase modulated sine wave is:

$$E_{RMS}=E_{peak}(\pi-\alpha+\tfrac{1}{2}\sin^2\alpha)^{\frac{1}{2}}$$

where $\alpha$ is the off angle (in this case [180,−38, or 141.2 degrees). Applying this formula results in a voltage of $E_{RMS}=0.174\ E_{peak}$.

During the turn on operation the filament voltage is delivered during the last 110 degrees of each half cycle (off angle of 70 degrees). Applying the same formula results in $E_{RMS}=0.597\ E_{peak}$.

The voltage delivered to the filaments during the lamp operation is, therefore, about 30% of the voltage applied to the filaments during lamp starting. The power consumed by the filaments is reduced by nearly 90%. This mode of operation may have two benefits, first the lower voltage sidacs, zener or like devices may be more economical and secondly, the additional filament heating during operation may extend lamp life.

Another element of this invention is that the impedance of the voltage sensing circuit can, if properly chosen, replace the auxillary capacitor in a multilamp series sequence ballast. If the value of capacitor 58 of FIG. 4 is on the order of 0.1 microfarads or higher, the auxillary capacitor may be omitted. It is suggested that the voltage sensing element (CR1 of FIG. 4) across the bypassed lamp have a low on-state impedance. For example, a bilateral semiconducting switch such as a sidac is a good choice. It should be pointed out that in this mode of operation, all the filaments will be activated simultaneously at lamp start up.

While several particular embodiments are discussed, it will be evident to one skilled in the art that this invention can be applied to a variety of ballasts and that it will work with high frequency electronic ballasts as well as with power frequency electromagnetic ballasts. Additionally, it could be used with other one lamp and multiple lamp rapid start ballasts such as low power factor lag ballasts. Although the primary discussion here is based mainly on a two lamp series ballast, the principles shown here can be extended to one lamp or multiple lamp series ballasts.

It is also contemplated that other electric components could be used that are functionally equivalent to the ones discussed relative to the Figures. For example, sidacs, glow bulbs, or back-to-back zener diodes can be interchanged without affecting the basic operation of this invention. Also, antiparallel SCR's, i.e., two SCR's connected in an inverse parallel mode so that one SCR is responsive to a positive halfwave and the other is responsive to a negative halfwave, could replace the triacs.

We claim:

1. A switching circuit for a rapid start type fluorescent lamp having a filament operating from a ballast transformer which supplies voltage to the filament and operating voltage to the lamp comprising a triggered switch in series with a lamp filament, voltage sensitive means connected to sense the voltage across the lamp, the triggered switch being connected to the voltage sensitive means and operated by the voltage sensitive means so that the triggered switch is on and the filament is supplied voltage from the ballast when the lamp arc is not struck and is essentially off when the voltage across the lamp drops after the lamp arc is struck to remove the voltage to the filament.

2. The switching circuit according to claim 1 further comprising a lead ballast for supplying power to the lamp filament.

3. The switching circuit according to claim 2 wherein said ballast includes a filament winding to supply an increased voltage to the lamp filament above its normal rated voltage to compensate for a voltage loss in the switching circuit.

4. The switching circuit according to claim 1 wherein the triggered switch comprises a triac and the voltage sensitive element is selected from the group consisting essentially of sidacs, diacs, zener diodes and glow bulbs.

5. A multilamp circuit for rapid start type fluorescent lamps having respective filaments operating from a ballast transformer which supplies voltage to the filaments and operating voltage to the lamps: filament switch means for connection between the ballast transformer and to the lamps, said filament switch means comprising a triggered switch in series with a filament of each lamp operated by the ballast, voltage sensitive means connected to sense the voltage across each lamp operated by the ballast, the triggered switch being connected to the voltage sensitive means to be operated thereby, said voltage sensitive means operating the triggered switch means of the individual lamps in sequence so that the triggered switch means of a lamp is on when the lamp arc is not struck and essentially off when the voltage across the lamp drops after the lamp arc is struck to strike the arc of each lamp in sequence.

6. The multilamp ballast switching circuit according to claim 5 wherein the voltage sensitive means has a switching value slightly less than the peak lamp voltage.

7. The filament switch of claim 1, wherein the ballast for supplying the voltage to the lamp is a lead type ballast in which lamp current leads the line voltage, said voltage sensitive means operating the triggered switch such that it is on cyclically for a long duration when the lamp is off and on cyclically for a short duration after the lamp filament is struck.

8. The multilamp ballast switching circuit of claim 5, further comprising an auxillary capacitor for bypassing a first lamp at the moment of starting a second lamp.

9. The switching circuit of claim 18, wherein the impedance means comprise one or more resistors.

10. The multilamp switching circuit of claim 5, further comprising two triggered switches, separately connected between at least one filament of a pair of lamps and a ballast secondary winding; a voltage sensitive switch means for sensing the voltage across a lamp; an impedance means for limiting the value of the trigger current applied from the voltage sensitive means to a triggered switch.

11. The multilamp switching circuit of claim 9, wherein the voltage sensitive means has a turn on value of 175 volts.

12. The multilamp switching circuit of claim 5, for operating a pair of lamps further comprising three triggered switches one each connected between the filament of a respective lamp and the ballast secondary winding; two voltage sensitive means connected to sense the voltage across the pair of lamps; a pair of impedance means for limiting the value of the trigger current supplied to said triggered switches.

13. The multilamp switching circuit of claim 11, wherein the three triggered switches are sensitive gate triacs.

14. The multilamp switching circuit of claim 11, wherein the voltage sensitive means comprise back to back zener diodes.

15. The multilamp switching circuit of claim 11, wherein the impedance means comprises a pair of capacitors and a pair of resistors.

16. The switching circuit of claim 3, wherein the ballast filament winding, having a nominal output of 4 volts rms, is increased to about 6 volts rms.

17. The switching circuit of claim 1, wherein the voltage sensitive means comprise back to back zener diodes and a sidac, having a switching value slightly less than the peak instantaneous lamp voltage, and means for making the lamp voltage lead the filament voltage before the peak lamp voltage for phase modulated filament heating.

18. The switching circuit of claim 1, further comprising impedance means for connecting the voltage sensitive means to sense the lamp voltage.

* * * * *